US010054885B2

(12) United States Patent
Okamoto et al.

(10) Patent No.: US 10,054,885 B2
(45) Date of Patent: Aug. 21, 2018

(54) PRESSURE AND PRESSURE RELIEF DEVICE, FIXING DEVICE, AND IMAGE FORMING APPARATUS

(71) Applicants: Jun Okamoto, Tokyo (JP); Yoshio Hattori, Kanagawa (JP); Yuusuke Furuichi, Kanagawa (JP); Haruyuki Honda, Kanagawa (JP); Kiwako Hiroi, Kanagawa (JP); Kenichi Hasegawa, Kanagawa (JP)

(72) Inventors: Jun Okamoto, Tokyo (JP); Yoshio Hattori, Kanagawa (JP); Yuusuke Furuichi, Kanagawa (JP); Haruyuki Honda, Kanagawa (JP); Kiwako Hiroi, Kanagawa (JP); Kenichi Hasegawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/604,212

(22) Filed: May 24, 2017

(65) Prior Publication Data

US 2017/0343942 A1 Nov. 30, 2017

(30) Foreign Application Priority Data

May 31, 2016 (JP) ..... 2016-109116

(51) Int. Cl.
*G03G 15/20* (2006.01)

(52) U.S. Cl.
CPC ..... *G03G 15/2089* (2013.01)

(58) Field of Classification Search
CPC ..... G03G 15/2089; G03G 15/2067; G03G 15/2053; G03G 15/2085; G03G 15/2064
See application file for complete search history.

(56) References Cited

U.S. PATENT DOCUMENTS

2005/0254846 A1 11/2005 Yura et al.
2007/0104503 A1* 5/2007 Kubo ..... G03G 15/2032 399/67
2007/0292175 A1 12/2007 Shinshi
(Continued)

FOREIGN PATENT DOCUMENTS

JP 5-173446 7/1993
JP 6-258977 9/1994
(Continued)

*Primary Examiner* — Francis C Gray
(74) *Attorney, Agent, or Firm* — Duft Bornsen & Fettig LLP

(57) ABSTRACT

A pressure and pressure relief device includes a rotator, a pressure body, a first pressure lever, and a biasing mechanism. The biasing mechanism includes a first elastic body, a second pressure lever, a cam, and a cam follower. A relations of L1>L3, L2>L4, and L3<L4 are satisfied. L1 represents a length between a first fulcrum of the first pressure lever and a point of load of the first pressure lever. L2 represents a length between the point of load of the first pressure lever and a hook portion of the first pressure lever. L3 represents a length between a pivot of the second pressure lever and a second fulcrum of the second pressure lever. L4 represents a length between the second fulcrum of the second pressure lever and a fastened portion of the second pressure lever.

11 Claims, 8 Drawing Sheets

(56) References Cited

U.S. PATENT DOCUMENTS

| | | | | |
|---|---|---|---|---|
| 2008/0069589 | A1* | 3/2008 | Chang | G03G 21/1685 399/122 |
| 2008/0199197 | A1* | 8/2008 | Suzuki | G03G 15/2025 399/67 |
| 2011/0222875 | A1* | 9/2011 | Imada | G03G 15/205 399/33 |
| 2012/0251206 | A1* | 10/2012 | Nakamura | G03G 15/206 399/329 |
| 2015/0016840 | A1* | 1/2015 | Maruko | G03G 15/2078 399/126 |
| 2016/0098000 | A1 | 4/2016 | Furuichi et al. | |
| 2016/0187822 | A1 | 6/2016 | Fukuhata et al. | |
| 2017/0003633 | A1 | 1/2017 | Hase et al. | |
| 2017/0097599 | A1 | 4/2017 | Fukuhata et al. | |
| 2017/0108807 | A1 | 4/2017 | Furuichi et al. | |

FOREIGN PATENT DOCUMENTS

| | | |
|---|---|---|
| JP | 2005-292713 | 10/2005 |
| JP | 2005-326524 | 11/2005 |
| JP | 2007-334205 | 12/2007 |
| JP | 2011-133502 | 7/2011 |
| JP | 2014-089233 | 5/2014 |

* cited by examiner ( a1 )

( a2 )

( b )

( c )

PRESSURE AND PRESSURE RELIEF DEVICE, FIXING DEVICE, AND IMAGE FORMING APPARATUS

CROSS-REFERENCE TO RELATED APPLICATION

This patent application is based on and claims priority pursuant to 35 U.S.C. § 119(a) to Japanese Patent Application No. 2016-109116, filed on May 31, 2016, in the Japan Patent Office, the entire disclosure of which is hereby incorporated by reference herein.

BACKGROUND

Technical Field

Embodiments of the present disclosure generally relate to a pressure and pressure relief device, a fixing device, and an image forming apparatus, and more particularly, to a pressure and pressure relief device for applying and relieving pressure, a fixing device for fixing a toner image on a recording medium, and an image forming apparatus for forming an image on a recording medium.

Related Art

Various types of electrophotographic image forming apparatuses are known, including copiers, printers, facsimile machines, and multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor as an image bearer. An optical writer irradiates the surface of the photoconductor thus charged with a light beam to form an electrostatic latent image on the surface of the photoconductor according to the image data. A developing device supplies toner to the electrostatic latent image thus formed to render the electrostatic latent image visible as a toner image. The toner image is then transferred onto a recording medium either directly, or indirectly via an intermediate transfer belt. Finally, a fixing device applies heat and pressure to the recording medium bearing the toner image to fix the toner image onto the recording medium. Thus, the image is formed on the recording medium.

Such a fixing device typically includes a fixing rotator, such as a roller, a belt, and a film, and a pressure rotator, such as a roller and a belt, pressed against the fixing rotator. The fixing rotator and the pressure rotator apply heat and pressure to the recording medium, melting and fixing the toner image onto the recording medium while the recording medium is conveyed between the fixing rotator and the pressure rotator.

Such a fixing device may have a configuration capable of applying pressure to the fixing nip and relieving the pressure applied to the fixing nip. This configuration suppresses compression set of an elastic body as a surface of the pressure roller while preventing paper jam.

SUMMARY

In one embodiment of the present disclosure, a novel pressure and pressure relief device is described that includes a rotator, a pressure body, a first pressure lever, and a biasing mechanism. The rotator is rotatable in a direction of rotation.

The pressure body presses against the rotator to sandwich and convey an object with the rotator. The first pressure lever is rotatably supported at a first fulcrum. The first pressure lever has a point of load to press the pressure body. The first pressure lever includes a hook portion. The biasing mechanism is coupled to the first pressure lever to press the pressure body against the rotator and to relieve pressure on the pressure body. The biasing mechanism includes a first elastic body, a second pressure lever, a cam, and a cam follower. The first elastic body is coupled to the hook portion of the first pressure lever. The second pressure lever is rotatably supported at a second fulcrum. The second pressure lever includes a continuous link extending in two directions from the second fulcrum at an angle. The cam is rotatable in a direction of rotation. The cam follower contacts the cam. The continuous link of the second pressure lever has one end including a fastened portion coupled to the first elastic body. The continuous link of the second pressure lever has another end including a pivot to rotatably support the cam follower. A relation of $L1>L3$, a relation of $L2>L4$, and a relation of $L3<L4$ are satisfied. L1 represents a length between the first fulcrum of the first pressure lever and the point of load of the first pressure lever. L2 represents a length between the point of load of the first pressure lever and the hook portion of the first pressure lever. L3 represents a length between the pivot of the second pressure lever and the second fulcrum of the second pressure lever. L4 represents a length between the second fulcrum of the second pressure lever and the fastened portion of the second pressure lever.

Also described is a novel fixing device incorporating the pressure and pressure relief device.

Also described is a novel image forming apparatus incorporating the fixing device.

BRIEF DESCRIPTION OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein.

The accompanying drawings are intended to depict embodiments of the present disclosure and should not be interpreted to limit the scope thereof. Also, identical or similar reference numerals designate identical or similar components throughout the several views.

DETAILED DESCRIPTION

Figure 1:
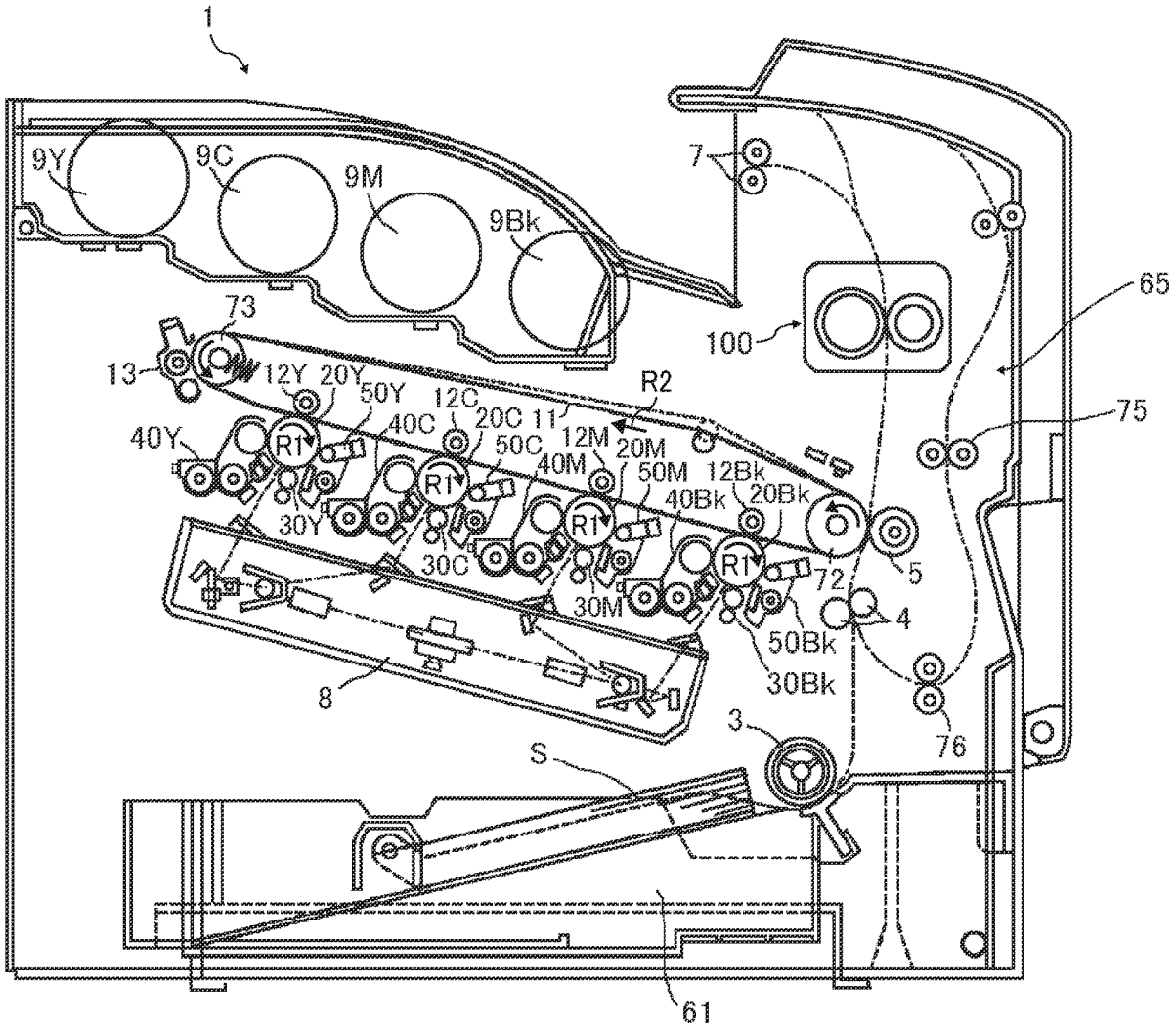
FIG. 1 is a schematic cross-sectional view of an image forming apparatus according to an embodiment of the present disclosure.

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and not all of the components or elements described in the embodiments of the present disclosure are indispensable to the present disclosure.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

As used herein, the singular forms "a", "an", and "the" are intended to include the plural forms as well, unless the context clearly indicates otherwise.

It is to be noted that, in the following description, suffixes Y, C, M, and Bk denote colors yellow, cyan, magenta, and black, respectively. To simplify the description, these suffixes are omitted unless necessary.

Referring now to the drawings, embodiments of the present disclosure are described below.

Initially with reference to FIG. 1, a description is given of a construction of an image forming apparatus 1 according to an embodiment of the present disclosure.

FIG. 1 is a schematic cross-sectional view of the image forming apparatus 1.

The image forming apparatus 1 is a color printer employing a tandem system in which a plurality of image forming devices for forming toner images in different colors is aligned in a direction in which a transfer belt is stretched. The image forming apparatus 1 forms color and monochrome toner images on a recording medium by electrophotography. Alternatively, the image forming apparatus 1 may be a monochrome printer that forms a monochrome toner image on a recording medium. The image forming apparatus 1 is not limited to a printer. Alternatively, the image forming apparatus 1 may be a copier, a facsimile machine, a multifunction peripheral or multifunction printer (MFP) having at least one of copying, printing, scanning, facsimile, and plotter functions, or the like.

As illustrated in FIG. 1, the image forming apparatus 1 includes photoconductors 20Y, 20C, 20M, and 20Bk arranged side by side in the center of the image forming apparatus 1. The photoconductors 20Y, 20C, 20M, and 20Bk are image bearers that bear toner images of yellow (Y), cyan (C), magenta (M), and black (Bk), respectively. Each of the photoconductors 20Y, 20C, 20M, and 20Bk is included in an image forming device that forms a toner image. The image forming devices have identical configurations, differing only in the color of toner employed.

In each of the image forming devices, the photoconductor 20 is surrounded by a charger 30, a developing device 40, and a cleaner 50. Specifically, the photoconductor 20Y is surrounded by a charger 30Y, a developing device 40Y, and a cleaner 50Y. The photoconductor 20C is surrounded by a charger 30C, a developing device 40C, and a cleaner 50C. The photoconductor 20M is surrounded by a charger 30M, a developing device 40M, and a cleaner 50M. The photoconductor 20Bk is surrounded by a charger 30Bk, a developing device 40Bk, and a cleaner 50Bk. The photoconductor 20 is rotatable in a clockwise direction of rotation (hereinafter referred to as a direction R1) in FIG. 1. The charger 30 presses against the surface of the photoconductor 20. The charger 30 rotates in accordance with rotation of the photoconductor 20. A high voltage power supply applies a given bias voltage to the charger 30. Accordingly, the charger 30 uniformly charges the surface of the photoconductor 20 rotating in the direction R1. It is to be noted that the photoconductor 20, the charger 30, the developing device 40, and the cleaner 50 are removable from the image forming apparatus 1.

The image forming apparatus 10 further includes an exposure device 8 being parallel to the four photoconductors 20Y, 20C, 20M, and 20Bk and tilted downward. The exposure device 8 includes, e.g., a light source, a polygon minor, an f-θ lens, and reflection mirrors. The exposure device 8 exposes the charged surface of the photoconductor 20Y, 20C, 20M, and 20Bk with light according to image data of yellow, cyan, magenta, and black, respectively. Thus, the exposure device 8 forms an electrostatic latent image on the photoconductor 20. The developing devices 40Y, 40C, 40M, and 40Bk supply toner of yellow, cyan, magenta, and black to the respective electrostatic latent images formed on the photoconductors 20Y, 20C, 20M, and 20Bk rotating in the direction R1. Thus, the developing device 40Y, 40C, 40M, and 40Bk visualize the electrostatic latent images into toner images of yellow, cyan, magenta, and black, respectively.

In an upper portion of the image forming apparatus 1 are toner bottles 9Y, 9C, 9M, and 9Bk containing fresh toner of yellow, cyan, magenta, and black, respectively. The fresh toner is supplied from the toner bottles 9Y, 9C, 9M, and 9Bk to the developing devices 40Y, 40C, 40M, and 40Bk through toner supply tubes interposed between the toner bottles 9Y, 9C, 9M, and 9Bk and the developing devices 40Y, 40C, 40M, and 40Bk, respectively.

An endless intermediate transfer belt 11 as an intermediate transfer body is disposed opposite the photoconductors 20Y, 20C, 20M, and 20Bk. The photoconductors 20Y, 20C, 20M, and 20Bk contact an outer circumferential surface of the intermediate transfer belt 11. The intermediate transfer belt 11 is entrained around a plurality of support rollers, such as support rollers 72 and 73. In the present example of FIG. 1, the support roller 72 is coupled to a drive motor as a drive source. As the drive motor drives and rotates the support roller 72, the intermediate transfer belt 11 rotates in a counterclockwise direction of rotation (hereinafter referred to as a direction R2) in FIG. 1. In accordance with rotation of the intermediate transfer belt 11, the support roller 73 rotates. Primary transfer rollers 12Y, 12C, 12M, and 12Bk are disposed inside a loop formed by the intermediate transfer belt 11. The primary transfer rollers 12Y, 12C, 12M, and 12Bk are disposed opposite the photoconductors 20Y, 20C, 20M, and 20Bk, respectively, via the intermediate transfer belt 11. The high voltage power supply applies a primary transfer bias to the primary transfer roller 12 to primarily transfer the toner image formed on the photoconductor 20 onto the intermediate transfer belt 11.

The cleaner 50 removes residual toner, which has failed to be transferred onto the intermediate transfer belt 11, and therefore, which is remaining on the photoconductor 20, from the photoconductor 20, rendering the photoconductor 20 ready for a next image formation.

Downstream from the primary transfer rollers 12Y, 12C, 12M, and 12Bk in the direction R2 is a secondary transfer roller 5 as a secondary transfer device. The secondary transfer roller 5 is disposed opposite the support roller 72 via the intermediate transfer belt 11 to form an area of contact, herein referred to as a secondary transfer nip, between the intermediate transfer belt 11 and the secondary transfer roller 5. The image forming apparatus 1 further includes, e.g., a sheet feeding device 61, a feeding roller 3, and a registration roller pair 4. The sheet feeding device 61 accommodates a plurality of sheets S as recording media. Downstream from the secondary transfer roller 5 in a direction of conveyance of the sheet S as a recording medium conveyance direction are a fixing device 100 and a sheet ejection roller pair 7. Thus, the fixing device 100 is disposed downstream from the photoconductors 20Y, 20C, 20M, and 20Bk (i.e., image bearers) in the direction of conveyance of the sheet S (i.e., recording medium conveyance direction).

To provide a fuller understanding of embodiments of the present disclosure, a description is now given of an image forming operation of the image forming apparatus 1 with continued reference to FIG. 1. As the image forming apparatus 1 receives a print job, a driver drives and rotates the photoconductor 20 clockwise in the direction R1 in FIG. 1. Dischargers emit light onto the surface of the respective photoconductors 20, initializing a surface potential of the photoconductor 20. The charger 30 uniformly charges the surface of the photoconductor 20 to a given polarity. The exposure device 8 emits laser beams onto the charged surface of the photoconductor 20 according to image data, thus forming an electrostatic latent image on the surface of the photoconductor 20. The image data used to expose the photoconductor 20 is monochrome image data produced by decomposing a desired full color image into yellow, cyan, magenta, and black image data. As the electrostatic latent image formed on the photoconductor 20 passes through a developing area where the electrostatic latent image faces the developing device 40, the developing device 40 supplies toner as a developer to the electrostatic latent image formed on the photoconductor 20. Thus, the developing device 40 renders the electrostatic latent image visible as a toner image.

The intermediate transfer belt 11 rotates counterclockwise in the direction R2 in FIG. 1. The primary transfer roller 12 is supplied with a primary transfer voltage having a polarity opposite a polarity of the charged toner of the toner image formed on the photoconductor 20. Accordingly, a transfer electric field is generated between the photoconductor 20 and the intermediate transfer belt 11. In the transfer electric field, the toner image is electrostatically transferred from the photoconductor 20 onto the intermediate transfer belt 11 rotating in synchronization with the photoconductor 20. That is, the toner image is primarily transferred onto the intermediate transfer belt 11. Specifically, the toner images of yellow, cyan, magenta, and black formed on the respective photoconductors 20Y, 20C, 20M, and 20Bk are primarily transferred from the upstream photoconductor 20Y to the downstream photoconductor Bk in the direction R2 at different times so that the toner images of yellow, cyan, magenta, and black are superimposed one atop another on the intermediate transfer belt 11. As a consequence, a desired full color toner image is formed on the intermediate transfer belt 11.

Meanwhile, a conveyance device such as the feeding roller 3 picks up and separates an uppermost sheet S from the plurality of sheets S resting on the sheet feeding device 61, to feed the uppermost sheet S to the registration roller pair 4. As a leading edge of the uppermost sheet S strikes a contact area between two rollers of the registration roller pair 4 before the registration roller pair 4 starts rotation, the registration roller pair 4 produces a loop of the sheet P, thus performing registration of the sheet S. Activation of the registration roller pair 4 is timed to convey the sheet S toward the secondary transfer nip between the intermediate transfer belt 11 and the secondary transfer roller 5 such that the sheet S meets the full color toner image borne by the intermediate transfer belt 11.

In the present embodiment, the secondary transfer roller 5 is supplied with a transfer voltage having a polarity opposite the polarity of the charged toner of the full color toner image formed on the intermediate transfer belt 11. Accordingly, the toner images of yellow, cyan, magenta, and black constructing the full color toner image is collectively transferred from the intermediate transfer belt 11 onto the sheet S at the secondary transfer nip. Then, the sheet P bearing the full color toner image is conveyed to the fixing device 100. The fixing device 100 applies heat and pressure to the sheet S, thereby fixing the full color toner image onto the sheet S.

Then, the sheet S bearing the fixed toner image is conveyed to the sheet ejection roller pair 7. The sheet ejection roller pair 7 ejects the sheet S onto an output portion, such as an output tray, of the image forming apparatus 1. Thus, the image forming operation completes. Upon duplex printing, the sheet S is conveyed to a duplex printing unit 65 disposed on the right side in the image forming apparatus 1 in FIG. 1. In the duplex printing unit 65, the sheet S is reversed and conveyed to the registration roller pair 4 again via conveyance rollers 75 and 76. The sheet S thus reaching the registration roller pair 4 follows the process described above. After the full color toner image is transferred onto the sheet S at the secondary transfer nip, an intermediate transfer belt cleaner 13 removes and collects residual toner, which has failed to be transferred onto the sheet S and therefore which is remaining on the intermediate transfer belt 11, from the intermediate transfer belt 11.

As described above, the image forming apparatus 1 forms a full color image on the sheet S. Alternatively, the image forming apparatus 1 may use one of the photoconductors 20Y, 20C, 20M, and 20Bk to form a monochrome image, or may use two or three of the photoconductors 20Y, 20C, 20M, and 20Bk to form a bicolor or tricolor image, respectively. Upon monochrome printing, an electrostatic latent image is formed on the photoconductor 20Bk and developed into a black toner image. The black toner image is transferred onto the intermediate transfer belt 11 and then transferred onto the sheet S. The fixing device 100 fixes the black toner image onto the sheet S. Thus, the image forming apparatus 1 forms a monochrome image on the sheet S.

Figure 2:
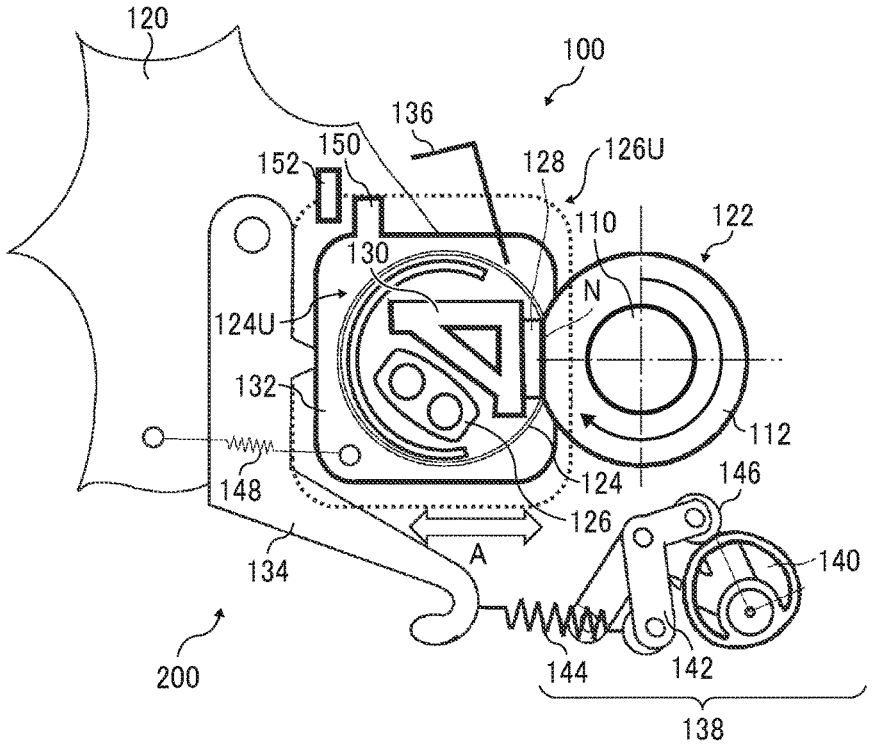
FIG. 2 is a schematic view of a fixing device incorporated in the image forming apparatus of FIG. 1.

Referring now to FIG. 2, a description is given of a construction of the fixing device 100 incorporated in the image forming apparatus 1 described above.

FIG. 2 is a schematic view of the fixing device 100.

As illustrated in FIG. 2, the fixing device 100 includes, e.g., a housing 120, an elastic roller 122, a fixing belt 124, a heater 126, a nip formation pad 128, and a support 130. In the present embodiment, the elastic roller 122 is a rotator rotatable in a direction of rotation as illustrated in FIG. 2. The fixing belt 124 is a pressure body to press against the elastic roller 122 to sandwich and convey the sheet S with the elastic roller 122. The heater 126, the nip formation pad 128, and the support 130 are disposed inside a loop formed by the fixing belt 124. The support 130 supports the nip formation pad 128. The fixing belt 124 and the components disposed inside the loop formed by the fixing belt 124 constitute a belt unit 124U, detachably coupled to the elastic roller 122. The fixing device 100 further includes a holder 132, a first pressure lever 134, a biasing mechanism 138, and a separator 136. The holder 132 holds each end of, e.g., the fixing belt 124 in an axial direction of the fixing belt 124 and the support 130 in a longitudinal direction of the support 130 parallel to the axial direction of the fixing belt 124. The first pressure lever 134 presses the holder 132. The biasing mechanism 138 biases the first pressure lever 134.

The housing 120 defines the entire fixing device 100. For the sake of simplicity, FIG. 2 illustrates a part of the housing 120 by a break line.

The elastic roller 122 has a shaft center secured to and supported by the housing 120. As a driving force generated by a driver (e.g., a motor) is transmitted to the elastic roller 122 through a gear train, the elastic roller 122 rotates in the direction of rotation as illustrated in FIG. 2. The elastic roller 122 is constructed of a cored bar 110, an elastic rubber layer 112 coating the cored bar 110, and a surface release layer coating the elastic rubber layer 112. The surface release layer is made of tetrafluoroethylene-perfluoroalkyl vinyl ether copolymer (PFA) or polytetrafluoroethylene (PTFE) to facilitate separation of the sheet S from the elastic roller 122. The elastic roller 122 may be a hollow roller or a solid roller. If the elastic roller 122 is a hollow roller, a heater such as a halogen heater may be disposed inside the hollow roller. The elastic rubber layer 112 may be made of solid rubber. Alternatively, if no heater is situated inside the elastic roller 122, the elastic rubber layer 112 may be made of sponge rubber. The sponge rubber is preferable to the solid rubber because the sponge rubber has enhanced insulation that draws less heat from the fixing belt 124.

The fixing belt 124 contacts the elastic roller 122 and rotates in accordance with rotation of the elastic roller 122. The heater 126 directly heats an inner circumferential surface of the fixing belt 124 with radiant heat. In the present embodiment, the heater 126 is constructed of two halogen heaters having light distributions axially different from each other. Alternatively, the heater 126 may be a single halogen heater or may be constructed of three or more halogen heaters. Alternatively, the heater 126 may be an induction heater (IH), a resistive heat generator, a carbon heater, or the like.

The fixing belt 124 is an endless belt or film made of a metal material, such as nickel or stainless steel (e.g., steel use stainless or SUS), or a resin material such as polyimide. The fixing belt 124 is constructed of a base layer and a release layer. The release layer, as an outer surface layer of the fixing belt 124, is made of PFA, PTFE, or the like to facilitate separation of toner of the toner image on the sheet S from the fixing belt 124. An elastic layer made of, e.g., silicone rubber may be interposed between the base layer and the release layer. If the fixing belt 124 does not incorporate the elastic layer made of silicone rubber, the fixing belt 124 has a decreased thermal capacity that improves fixing property of being heated quickly to a desired fixing temperature at which the toner image is fixed on the sheet S. However, as the elastic roller 122 and the fixing belt 124 sandwich and press the unfixed toner image on the sheet S, slight surface asperities in the fixing belt 124 may be transferred onto the toner image on the sheet S, resulting in variation in gloss of the solid toner image that may appear as an orange peel image on the sheet S. To address this circumstance, the elastic layer made of silicone rubber has a thickness not smaller than about 100 μm. As the elastic layer made of silicone rubber deforms, the elastic layer absorbs slight surface asperities in the fixing belt 124. Accordingly, formation of the faulty orange peel image is prevented. As a consequence, improved imaging quality can be provided.

The nip formation pad 128 is disposed inside the loop formed by the fixing belt 124. The nip formation pad 128 forms an area of contact, herein referred to as a fixing nip N, between the fixing belt 124 and the elastic roller 122. As the fixing belt 124 rotates, the inner circumferential surface of the fixing belt 124 slides over the nip formation pad 128 directly, or indirectly via a slide sheet interposed between the fixing belt 124 and the nip formation pad 128. In the present embodiment illustrated in FIG. 2, the fixing nip N is planar. Alternatively, the fixing nip N may be contoured into a recess or other shapes. If the fixing nip N defines the recess in the fixing belt 124, the recessed fixing nip N directs the leading edge of the sheet S toward the elastic roller 122 as the sheet S is ejected from the fixing nip N, facilitating separation of the sheet S from the fixing belt 124 and suppressing paper jam. It is to be noted that the nip formation pad 128 may also function as a planar heat generator to heat the fixing belt 124 locally at the fixing nip N.

The support 130 is disposed inside the loop formed by the fixing belt 124. In the present embodiment, the support 130 is a stay that supports the fixing nip N. As the nip formation pad 128 receives pressure from the elastic roller 122, the support 130 prevents the nip formation pad 128 from being bent by such pressure, thereby maintaining a uniform width of the fixing nip N across the axial direction of the fixing belt 124 and the elastic roller 122. A reflector is interposed between the heater 126 and the support 130. The reflector reflects the heat radiating from the heater 126 toward the inner circumferential surface of the fixing belt 124, thereby preventing the support 130 from being heated unnecessarily by the heater 126 and suppressing waste of energy. Alternatively, instead of providing the reflector, a surface of the support 130 facing the heater 126 may be insulated or given a mirror finish to reflect the heat radiating from the heater 126 toward the inner circumferential surface of the fixing belt 124.

The holder 132 (e.g., flange) holds each end of the support 130 in the longitudinal direction thereof. In addition to the support 130, the holder 132 holds each end of the fixing belt 124 in the axial direction thereof and each end of the nip formation pad 128 and the heater 126 in a longitudinal direction thereof. These components are hereinafter collectively referred to as a heater-side assembly 126U. The holder 132 is supported by the housing 120 and is movable in directions A relative to the housing 120 as illustrated in FIG. 2.

The first pressure lever 134 is provided on a side of holder 132 opposite the elastic roller 122. The first pressure lever 134 is rotatable relative to the housing 120. The first pressure lever 134 presses the holder 132 toward the elastic roller 122. The biasing mechanism 138 biases the first pressure lever 134. The biasing mechanism 138 includes a cam 140 rotated by a driver (e.g., motor), a second pressure lever 142, and a pressure spring 144. As the biasing mechanism 138 biases the first pressure lever 134, the holder 132 (i.e., the heater-side assembly 126U) is pressed to and thus is disposed at a pressure position to form the fixing nip N when the sheet S is conveyed through the fixing nip N. On the other hand, when the sheet S is not conveyed through the fixing nip N, the holder 132 (i.e., the heater-side assembly 126U) is moved away from the pressure position and thus is disposed at a pressure relief position where the holder 132 (i.e., the heater-side assembly 126U) is released from pressure from the first pressure lever 134, to prevent compression set of the elastic roller 122. Thus, the holder 132 is movable to the pressure position and to the pressure relief position relative to the housing 120. The heater-side assembly 126U may serve as a pressure body to press against the elastic roller 122 as a rotator.

The fixing belt 124 rotates in accordance with rotation of the elastic roller 122. In the present embodiment illustrated in FIG. 2, as the driver drives and rotates the elastic roller 122, a driving force of the driver is transmitted from the elastic roller 122 to the fixing belt 124 at the fixing nip N, thus rotating the fixing belt 124 by friction between the elastic roller 122 and the fixing belt 124. At the fixing nip N, the fixing belt 124 rotates while being sandwiched between the elastic roller 122 and the nip formation pad 128. On the other hand, at a location other than the fixing nip N, the fixing belt 124 rotates while being guided by the holder 132 situated at each end of the fixing belt 124 in the axial direction thereof. With the construction described above, the fixing device 100 attaining quick warm-up is produced at reduced costs.

The separator 136 is disposed downstream from the fixing nip N in the direction of conveyance of the sheet S to separate the sheet S from the fixing belt 124.

Figure 3:
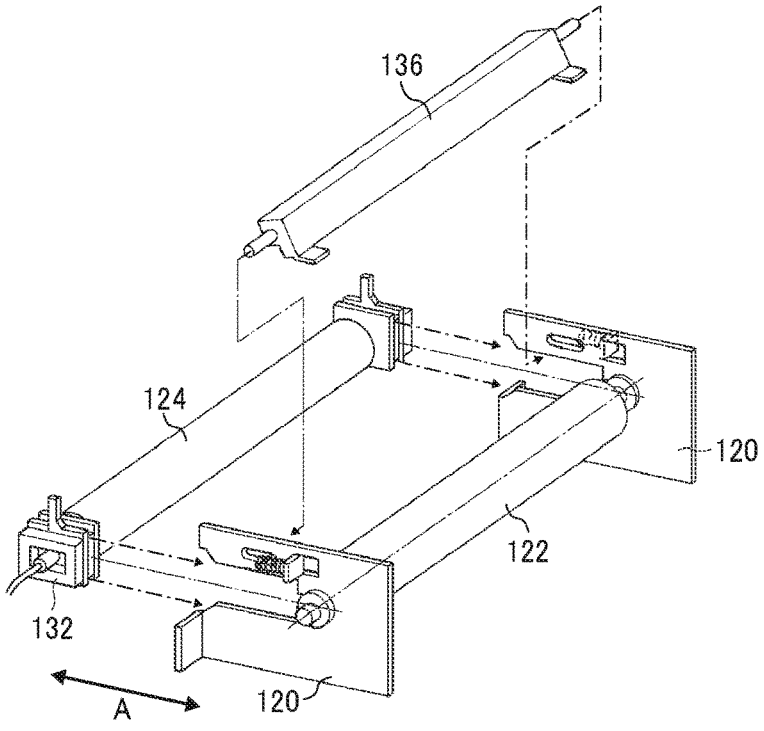
FIG. 3 is a partial perspective view of the fixing device of FIG. 2.

FIG. 3 is a partial perspective view of the fixing device 100 described above.

As illustrated in FIG. 3, the holder 132 and the housing 120 are shaped like a guide and a rail, respectively. Therefore, the holder 132 is movable to the shaft center of the elastic roller 122 while being supported by the housing 120. That is, the first pressure lever 134, illustrated in FIG. 2, moves the heater-side assembly 126U in the directions A. When the sheet S is conveyed through the fixing nip N, the heater-side assembly 126U presses against the elastic roller 122 to form the fixing nip N. On the other hand, when the sheet S is not conveyed through the fixing nip N, the heater-side assembly 126U is moved away from the elastic roller 122, releasing the elastic roller 122 from pressure.

Now, a description is given of a pressure and pressure relief device 200 incorporated in the fixing device 100 described above.

Figure 4:
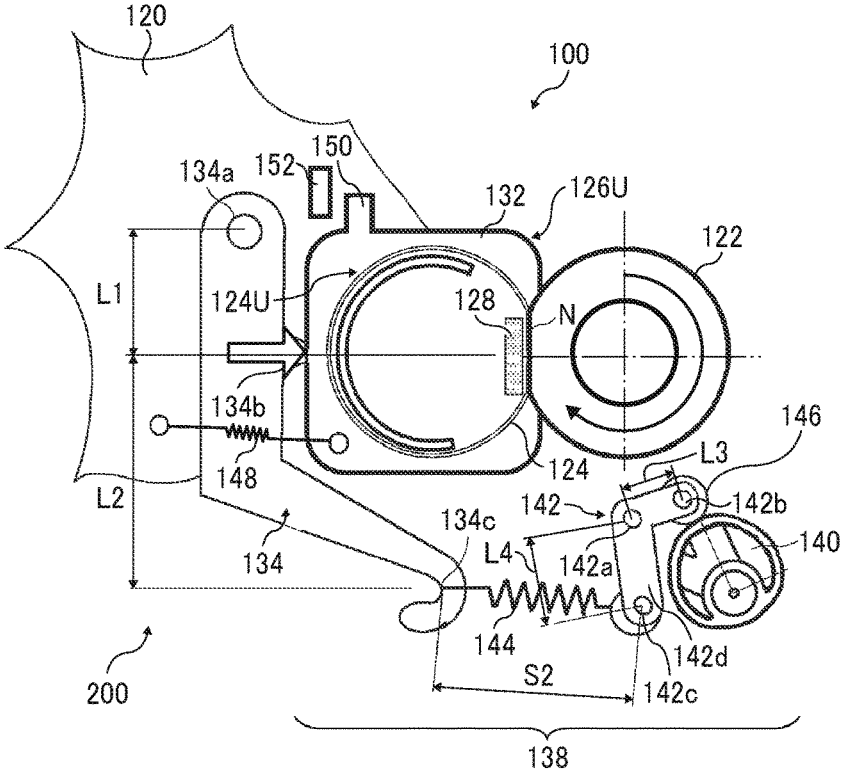
FIG. 4 is a schematic view of a pressure and pressure relief device incorporated in the fixing device of FIG. 2, illustrating the pressure and pressure relief device applying pressure.

FIG. 4 is a schematic view of the pressure and pressure relief device 200, illustrating the pressure and pressure relief device 200 applying pressure.

The pressure and pressure relief device 200 applies pressure to the fixing nip N and relieves the pressure applied to the fixing nip N. It is to be noted that identical reference numerals are assigned to components illustrated in FIG. 4 that are identical to the components illustrated in FIG. 2, and that a description of the identical components is herein omitted.

The first pressure lever 134 is rotatable about a first fulcrum 134*a*. the first pressure lever 134 is supported by the housing 120 at the first fulcrum 134*a*. When the biasing mechanism 138 presses the first pressure lever 134, a pressure portion 134*b* of the first pressure lever 134 contacts the holder 132 to press the fixing belt 124 toward the shaft center of the elastic roller 122. That is, the pressure portion 134*b* is a point of load of the first pressure lever 134, where the force is output.

Figure 5:
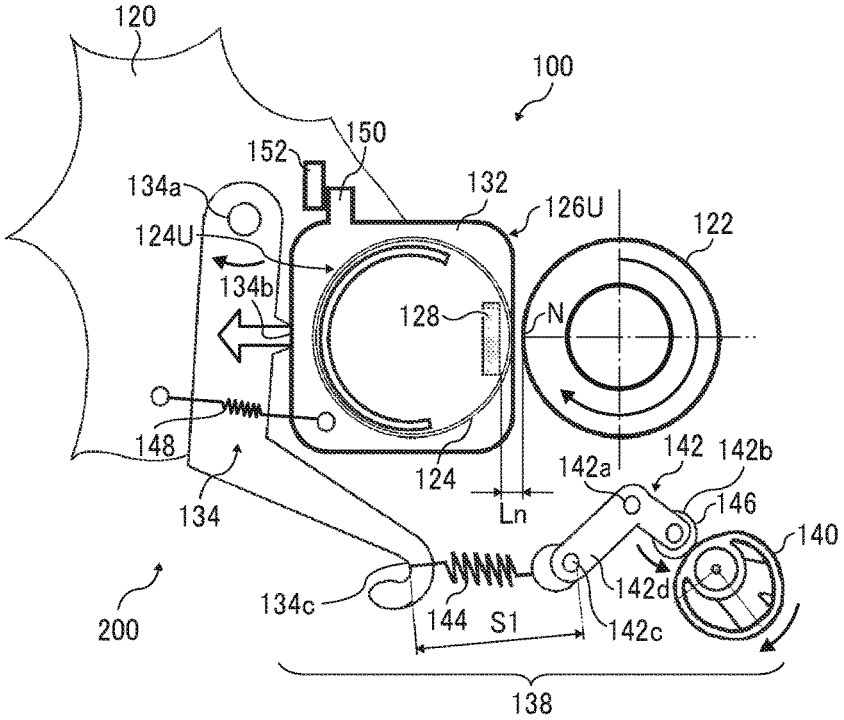
FIG. 5 is a schematic view of the pressure and pressure relief device, illustrating the pressure and pressure relief device relieving pressure.

As described above, the biasing mechanism 138 includes the cam 140, the second pressure lever 142, and the pressure spring 144. The cam 140 is rotated by the driver (e.g., motor), thus being rotatable in a direction of rotation as illustrated in FIG. 5. The second pressure lever 142 is rotatable about a second fulcrum 142*a*. The second pressure lever 142 is supported by the housing 120 at the second fulcrum 142*a*. The pressure spring 144 is a first elastic body that is coupled to a hook portion 134*c* of the first pressure lever 134. That is, the hook portion 134*c* is a point of effort of the first pressure lever 134, where the force is input. The second pressure lever 142 includes a continuous link 142*d* extending in two directions from the second pressure lever 142 at an angle.

The continuous link 142*d* of the second pressure lever 142 has one end coupled to the pressure spring 144 at a fastened portion 142*c*. In other words, the one end of the continuous link 142*d* of the second pressure lever 142 includes the fastened portion 142*c* coupled to the pressure spring 144. The continuous link 142*d* of the second pressure lever 142 has another end provided with a cam follower 146. The cam follower 146 rotates about a pivot 142*b* of the second pressure lever 142. The cam 140 is located facing an obtuse angle formed by the continuous two link 142*d* of the second pressure lever 142.

In FIG. 4, L1 represents a length between the first fulcrum 134*a* of the first pressure lever 134 and the pressure portion 134*b* of the first pressure lever 134. L2 represents a length between the pressure portion 134*b* of the first pressure lever 134 and the hook portion 134*c* of the first pressure lever 134. L3 represents a distance (i.e., length) between the second fulcrum 142*a* of the second pressure lever 142 and the pivot 142*b* of the second pressure lever 142. L4 represents a distance (i.e., length) between the second fulcrum 142*a* of the second pressure lever 142 and the fastened portion 142*c* of the second pressure lever 142.

In the present embodiment, a relation of L1>L3, a relation of L2>L4, and a relation of L3<L4 are satisfied. According to the relation of L1>L3 and the relation of L2>L4, the second pressure lever 142 is smaller than the first pressure lever 134. According to the relation of L3<L4, the second pressure lever 142 increases a force generated in a cam mechanism by a leverage ratio of L4/L3. Accordingly, the cam 140 is downsized compared to a comparative cam. That is, an output torque of the driver (e.g., motor) that drives the cam mechanism can be decreased. Therefore, an inexpensive driver can be used as the driver that drives the cam mechanism compared to a comparative driver. Accordingly, the pressure and pressure relief device 200 is downsized and produced at reduced cost compared to a comparative pressure and pressure relief device.

FIG. 5 is a schematic view of the pressure and pressure relief device 200, illustrating the pressure and pressure relief device 200 relieving pressure.

It is to be noted that identical reference numerals are assigned to components illustrated in FIG. 5 that are identical to the components illustrated in FIG. 4, and that a description of the identical components is herein omitted.

With reference to FIG. 5, a description is given of the pressure and pressure relief device 200 relieving pressure. When the pressure and pressure relief device 200 relieves pressure, the cam 140 rotates in a clockwise direction in FIG. 5 while the cam follower 146 of the second pressure lever 142 rotates about the pivot 142*b* in a counterclockwise direction in FIG. 5. Since the cam follower 146 moves from an upper fulcrum of the cam 140 to a lower fulcrum of the cam 140, a length of the pressure spring 144, that is, a distance between the hook portion 134*c* of the first pressure lever 134 and the fastened portion 142*c* of the second pressure lever 142 is changed from a distance S2 illustrated in FIG. 4 to a distance S1 illustrated in FIG. 5. The distance S1 is smaller than the distance S2.

The nip formation pad 128 that forms the fixing nip N in FIG. 4 is moved away from the shaft center of the elastic roller 122. As a consequence, a gap is formed between the nip formation pad 128 and the elastic roller 122, producing a pressure releasing amount Ln.

Figure 6:
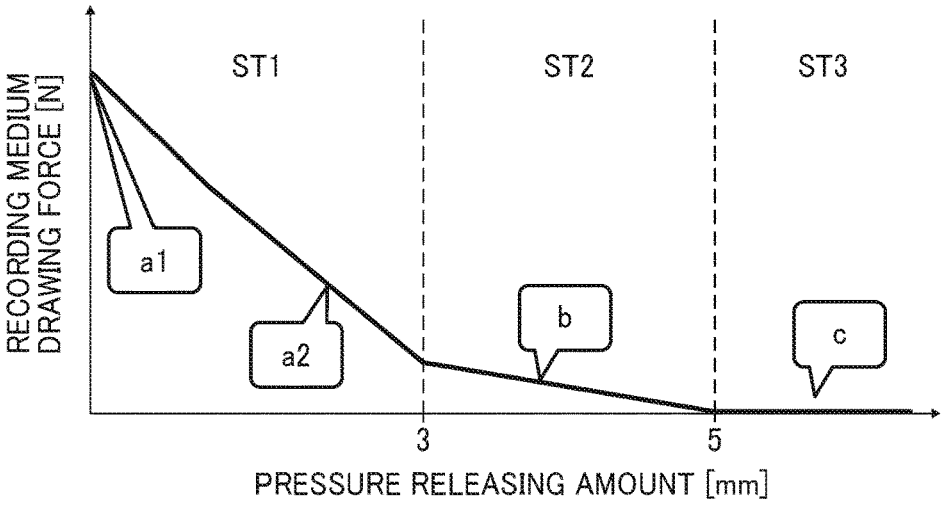
FIG. 6 is a graph illustrating a relationship between pressure releasing amount and recording medium drawing force.

FIG. 6 is a graph illustrating a relationship between the pressure releasing amount and recording medium drawing force.

In FIG. 6, the horizontal axis indicates the pressure releasing amount (mm). The vertical axis indicates the recording medium drawing force (N). ST1 represents a pressure state span, including a first pressure state (a1) and a second pressure state (a2). ST2 represents a pressure relief state span, including a pressure relief state (b). ST3 is a complete separation state span, including a complete separation state (c).

Figure 7A:
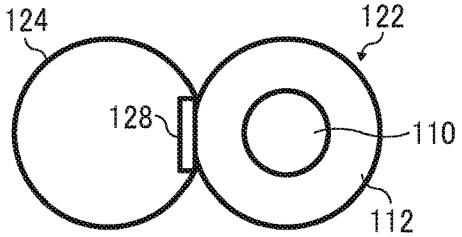
FIG. 7A is a schematic view of a fixing belt and an elastic roller incorporated in the fixing device of FIG. 2; illustrating relative positions thereof in a first pressure state.
Figure 7B:
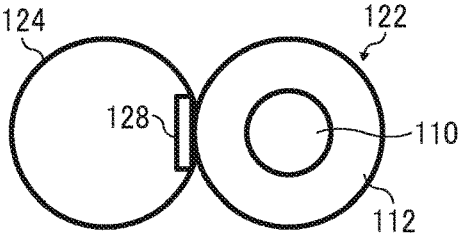
FIG. 7B is a schematic view of the fixing belt and the elastic roller, illustrating relative positions thereof in a second pressure state.
Figure 7C:
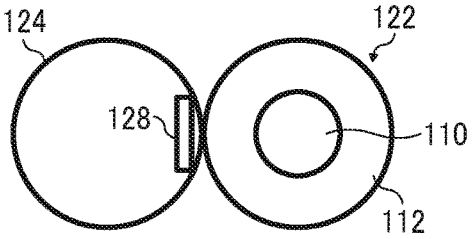
FIG. 7C is a schematic view of the fixing belt and the elastic roller, illustrating relative positions thereof in a pressure relief state.
Figure 7D:
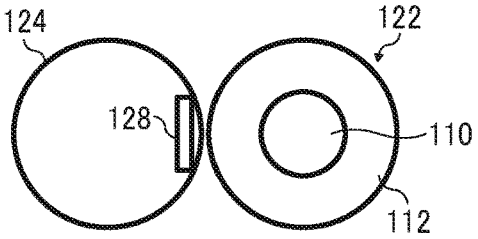
FIG. 7D is a schematic view of the fixing belt and the elastic roller, illustrating relative positions thereof in a complete separation state.

FIGS. 7A through 7D illustrate relative positions of the fixing belt 124 and the elastic roller 122. Specifically, FIG. 7A is a schematic view of the fixing belt 124 and the elastic roller 122, illustrating relative positions thereof in the first pressure state (a1). FIG. 7B is a schematic view of the fixing belt 124 and the elastic roller 122, illustrating relative positions thereof in the second pressure state (a2). FIG. 7C is a schematic view of the fixing belt 124 and the elastic roller 122, illustrating relative positions thereof in the pressure relief state (b). FIG. 7D is a schematic view of the fixing belt 124 and the elastic roller 122, illustrating relative positions thereof in the complete separation state (c).

In FIGS. 6 and 7, the pressure state refers to a state in which the elastic rubber layer 112 of the elastic roller 122 is compressed with a pressure releasing amount of from 0 mm to 3 mm. The pressure relief state refers to a state in which the elastic rubber layer 112 of the elastic roller 122 is released from compression and the fixing belt 124 is deformed with a pressure releasing amount of from 3 mm to 5 mm. The complete separation state refers to a state in which the elastic roller 122 and the fixing belt 124 are separated from each other with a pressure releasing amount not smaller than 5 mm.

When the nip formation pad 128 is moved away from the elastic roller 122 from the pressure state (a1) to the pressure state (a2), the elastic rubber layer 112 of the elastic roller 122 decreases in compression amount. In accordance with the decrease in compression amount of the elastic rubber layer 112, the recording medium drawing force decreases. In the pressure relief state (b), the fixing belt 124 deforms and sandwiches the sheet S (i.e., recording medium) together with the elastic roller 122. Therefore, the recording medium drawing force is still generated. Since the rigidity of the fixing belt 124 is lower than the rigidity of the elastic rubber layer 112 of the elastic roller 122, the recording medium drawing force decreases gradually in the pressure relief state span ST2 compared to the decrease in the recording medium drawing force in the pressure state span ST1 from the first pressure state (a1) to the second pressure state (a2), as illustrated in FIG. 6. As the pressure releasing amount increases further, the fixing belt 124 and the elastic roller 122 are separated from each other in the complete separation state (c), in which the recording medium drawing force becomes zero.

Thus, the pressure and pressure relief device 200 produces sufficient pressure releasing amount, thereby facilitating paper jam treatment.

Now, a description is given of advantageous configurations of the fixing device 100 and the pressure and pressure relief device 200.

For example, as illustrated in FIGS. 2, 4, and 5, the housing 120 and the holder 132 are coupled to each other with a tension spring 148 as a second elastic body to bias the heater-side assembly 126U in a pressure relief direction in which the heater-side assembly 126U is moved away from the elastic roller 122. That is, the tension spring 148 coupled to the housing 120 and to the holder 132 biases the holder 132 (i.e., the heater-side assembly 126U) in the pressure relief direction to relieve pressure on the fixing nip N. In other words, the tension spring 148 biases the fixing belt 124 away from the elastic roller 122. The holder 132 includes an abutting portion 150 while the housing 120 is provided with a stopper 152 that contacts the abutting portion 150. The abutting portion 150 and the stopper 152 are regulators to regulate a moving amount of the holder 132. In the present embodiment, the biasing force of the tension spring 148 is sufficiently smaller than the biasing force of the pressure spring 144 such that the influence of the biasing force of the tension spring 148 is ignored.

In the pressure relief state, the pressure spring 144 has a length in unloaded conditions, releasing the force applied to the first pressure lever 134. In this state, the holder 132 is moved away from the elastic roller 122 by the biasing force of the tension spring 148 in a compressing direction in which the tension spring 148 is compressed. When the abutting portion 150 of the holder 132 abuts against the stopper 152, the holder 132 stops moving. The moving amount of the holder 132 determines the recording medium drawing force.

As illustrated in FIGS. 6 and 7, the recording medium drawing force is relatively large in the pressure state. On the other hand, in the complete separation state, the recording medium falls freely and may move to an unintended location. To address this circumstance, the pressure releasing amount Ln is preferably in a range of the pressure relief state. Specifically, the pressure releasing amount Ln is calculated by Equation 1 below:

radial compression amount of elastic roller<Ln<radial compression amount of elastic roller+deformation amount of fixing belt Equation 1.

In the present embodiment, the pressure releasing amount Ln is set to 4 mm in the range of the pressure relief state.

In the example described above, the housing 120 and the holder 132 are coupled to each other with the tension spring 148 to bias the heater-side assembly 126U in the pressure relief direction. Alternatively, the housing 120 and the support 130 may be coupled to each other with the tension spring 148. Alternatively, the housing 120 and the nip formation pad 128 may be coupled to each other with the tension spring 148. Instead of the tension spring 148, a compression spring or a flat spring may be used. Alternatively, a motor or a solenoid may be used as a biasing device.

Figure 8:
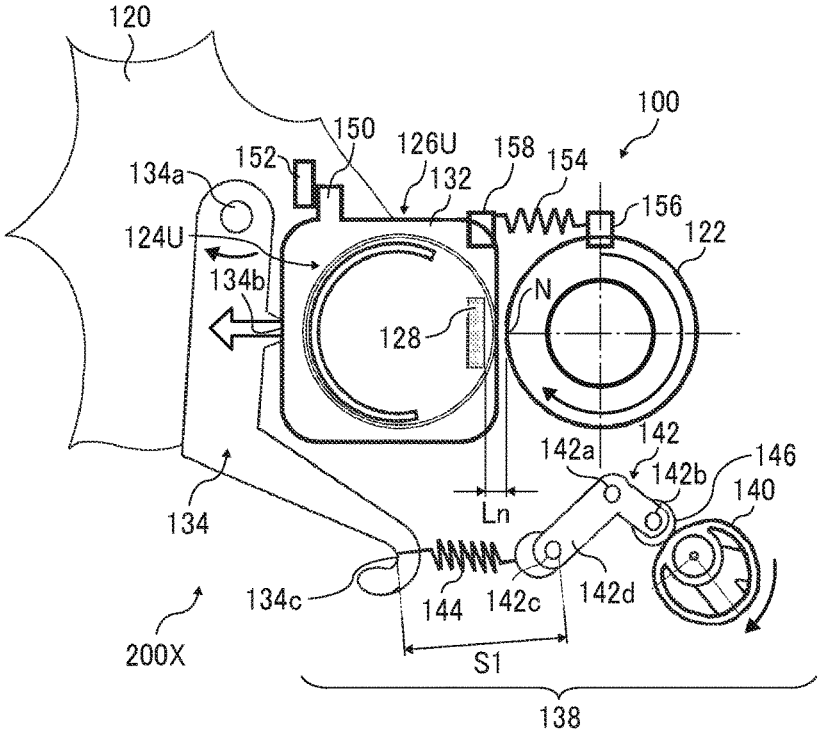
FIG. 8 is a schematic view of a pressure and pressure relief device incorporating a compression spring according to another embodiment of the present disclosure, illustrating the pressure and pressure relief device relieving pressure.

Referring now to FIG. 8, a description is given of an example in which a compression spring 154 is used instead of the tension spring 148.

FIG. 8 is a schematic view of a pressure and pressure relief device 200X according to another embodiment of the present disclosure, illustrating the pressure and pressure relief device 200X relieving pressure.

The pressure and pressure relief device 200X incorporates the compression spring 154 instead of the tension spring 148. The biasing force of the compression spring 154 moves the holder 132 in the pressure relief direction. That is, the compression spring 154 biases the fixing belt 124 away from the elastic roller 122. In the pressure and pressure relief device 200X of FIG. 8, the housing 120 has a first receiving surface 156. The holder 132 has a second receiving surface 158.

Referring now to FIGS. 9 through 13, a description is given of some variations of the pressure and pressure relief device 200 and the fixing device 100.

Figure 9:
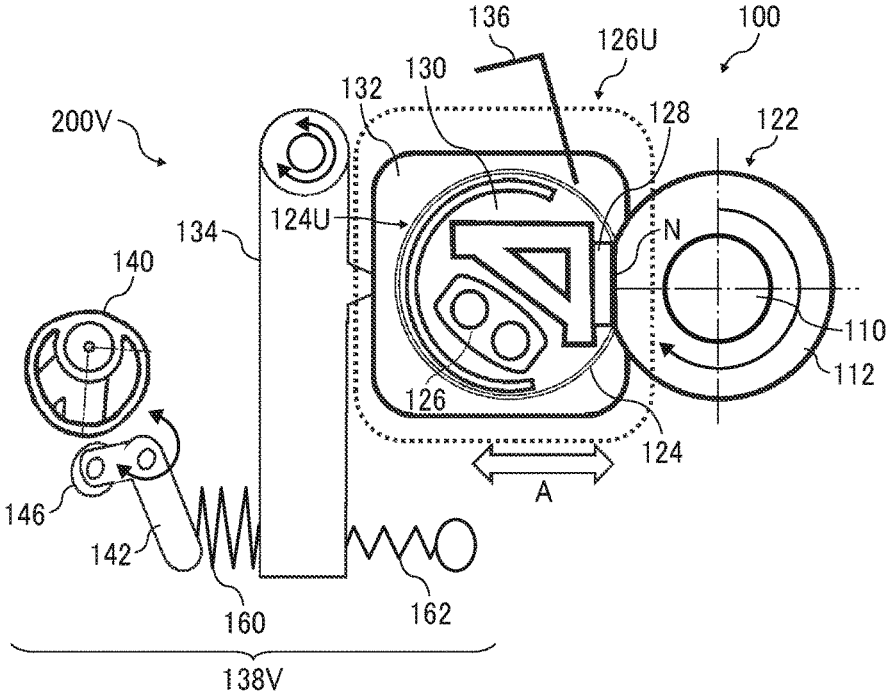
FIG. 9 is a schematic view of a variation of the pressure and pressure relief device.

FIG. 9 is a schematic view of a pressure and pressure relief device 200V.

The pressure and pressure relief device 200 illustrated in FIGS. 4 and 5 incorporates the pressure spring 144 as a single pressure spring. By contrast, in the pressure and pressure relief device 200V, a biasing mechanism 138V includes two pressure springs, namely, a first pressure spring 160 and a second pressure spring 162. The first pressure spring 160 is interposed between the first pressure lever 134 and the second pressure lever 142. The housing 120 is provided with the second pressure spring 162 that biases the first pressure lever 134 toward the second pressure lever 142. Accordingly, the cam 140 and the second pressure lever 142 are disposed opposite the fixing nip N via the first pressure lever 134.

Figure 10:
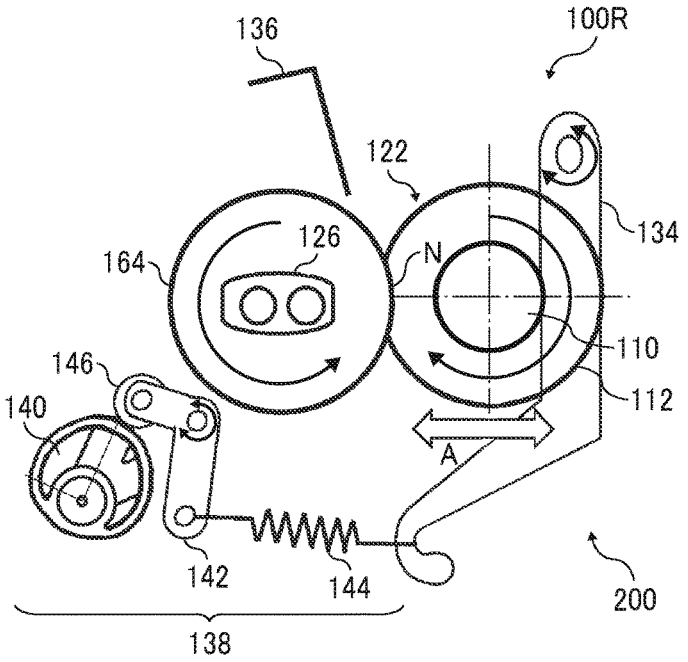
FIG. 10 is a schematic view of the pressure and pressure relief device applied to a fixing device employing a roller fixing system.

FIG. 10 is a schematic view of the pressure and pressure relief device 200 applied to a fixing device 100R employing a roller fixing system.

In the present variation of FIG. 10, the fixing device 100R includes a fixing roller 164 instead of the fixing belt 124. The first pressure lever 134 presses the elastic roller 122 against the fixing roller 164 and relieves pressure on the elastic roller 122. That is, in the present variation, the fixing roller 164 serves as a rotator rotatable in a direction of rotation as illustrated in FIG. 10 while the elastic roller 122 serves as a pressure body to press against the rotator. The heater 126 is disposed inside the fixing roller 164 to heat the fixing roller 164. Other basic structure illustrated in FIG. 10 is identical to the structure illustrated in FIGS. 4 and 5. Therefore, identical reference numerals are assigned to components illustrated in FIG. 10 that are identical to the components illustrated in FIGS. 4 and 5. A description of the identical components is herein omitted.

Figure 11:
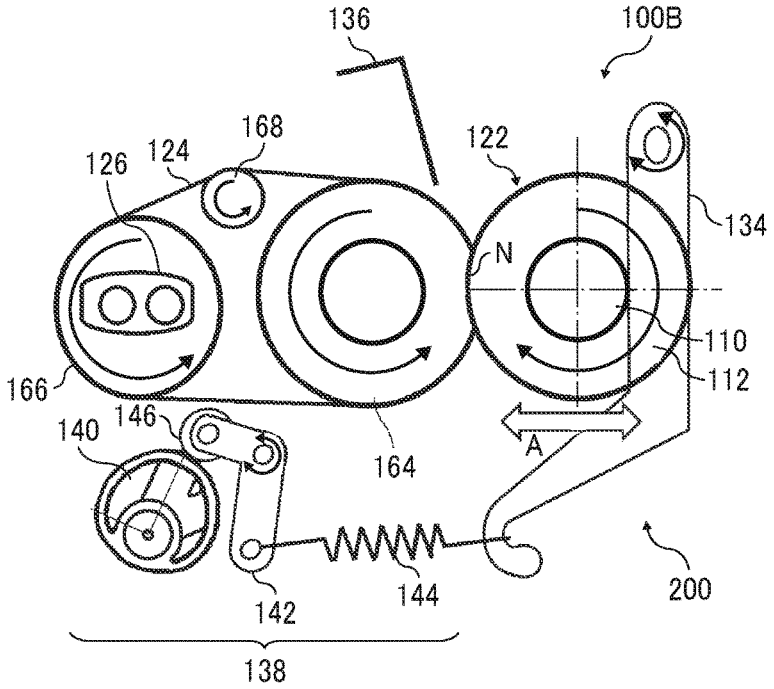
FIG. 11 is a schematic view of the pressure and pressure relief device applied to a fixing device employing a belt fixing system.

FIG. 11 is a schematic view of the pressure and pressure relief device 200 applied to a fixing device 100B employing a belt fixing system.

As illustrated in FIG. 11, the fixing belt 124 is entrained around a heating roller 166, a tension roller 168, and a fixing roller 164. In the present variation of FIG. 11, the first pressure lever 134 presses the elastic roller 122 against the fixing belt 124 and relieves pressure on the elastic roller 122. That is, in the present variation, the fixing belt 124 serves as a rotator rotatable in a direction of rotation as illustrated in FIG. 11 while the elastic roller 122 serves as a pressure body to press against the rotator. Other basic structure illustrated in FIG. 11 is identical to the structure illustrated in FIGS. 4 and 5. Therefore, identical reference numerals are assigned to components illustrated in FIG. 11 that are identical to the components illustrated in FIGS. 4 and 5. A description of the identical components is herein omitted.

Figure 12:
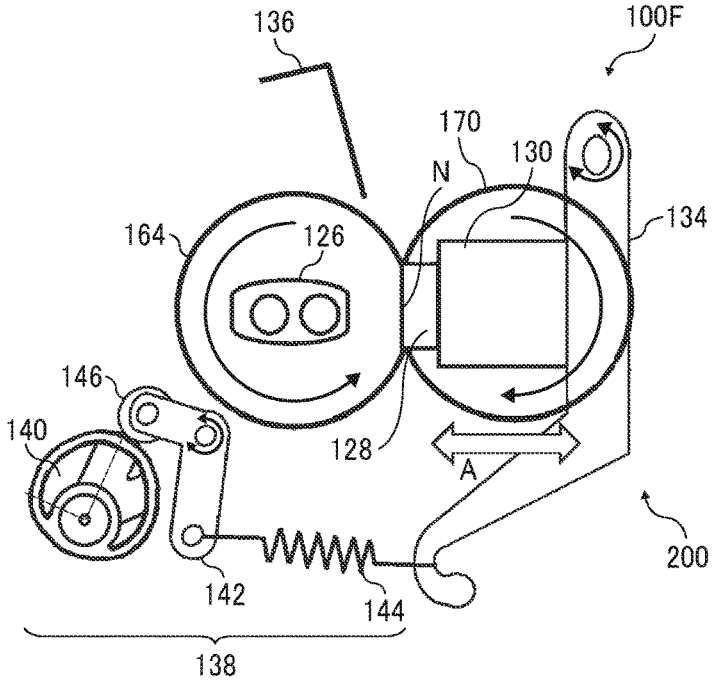
FIG. 12 is a schematic view of the pressure and pressure relief device applied to a fixing device employing a free belt nip (FBN) system.

FIG. 12 is a schematic view of the pressure and pressure relief device 200 applied to a fixing device 100F employing a free belt nip (FBN) system.

As illustrated in FIG. 12, the fixing roller 164 contacts a pressure belt 170, thereby forming the fixing nip N between the fixing roller 164 and the pressure belt 170. In the present variation of FIG. 12, the first pressure lever 134 presses the pressure belt 170 against the fixing roller 164 and relieves pressure on the pressure belt 170. That is, in the present variation, the fixing roller 164 serves as a rotator rotatable in a direction of rotation as illustrated in FIG. 12 while the pressure belt 170 serves as a pressure body to press against the rotator. Other basic structure illustrated in FIG. 12 is identical to the structure illustrated in FIGS. 4 and 5. Therefore, identical reference numerals are assigned to components illustrated in FIG. 12 that are identical to the components illustrated in FIGS. 4 and 5. A description of the identical components is herein omitted.

Figure 13:
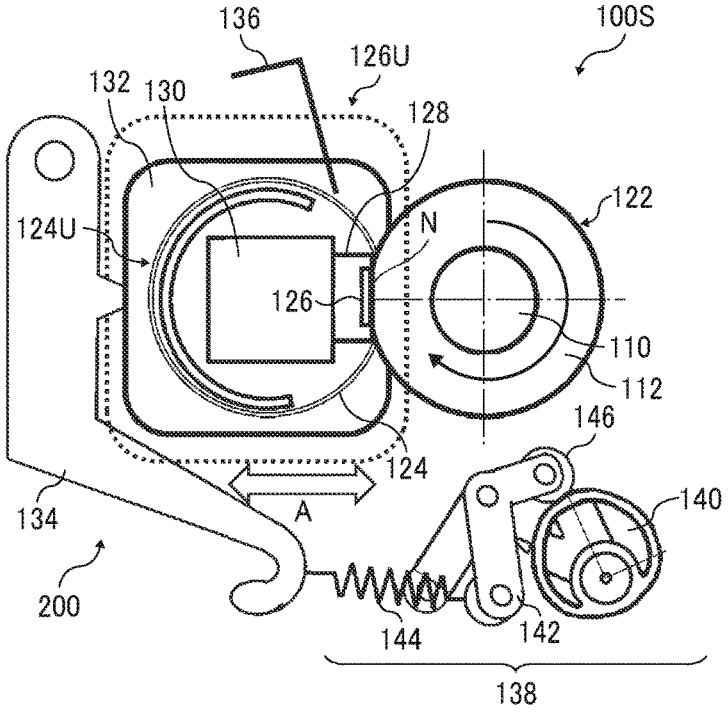
FIG. 13 is a schematic view of the pressure and pressure relief device applied to a fixing device employing a surface rapid fusing (SURF) system.

FIG. 13 is a schematic view of the pressure and pressure relief device 200 applied to a fixing device 100S employing a surface rapid fusing (SURF) system.

As illustrated in FIG. 13, the fixing belt 124 contacts the elastic roller 122, thereby forming the fixing nip N between the fixing belt 124 and the elastic roller 122. The nip formation pad 128 is provided with a planar heat generator as the heater 126. In the present variation of FIG. 13, the first pressure lever 134 presses against the holder 132 and relieves pressure on the holder 132. Other basic structure illustrated in FIG. 13 is identical to the structure illustrated in FIGS. 4 and 5. Therefore, identical reference numerals are assigned to components illustrated in FIG. 13 that are identical to the components illustrated in FIGS. 4 and 5. A description of the identical components is herein omitted.

In the embodiments described above, the pressure and pressure relief device is applied to the fixing device. Alternatively, the pressure and pressure relief device can be applied to other devices, and the structure of the pressure and pressure relief device is not limited to the structures described above.

Figure 14:
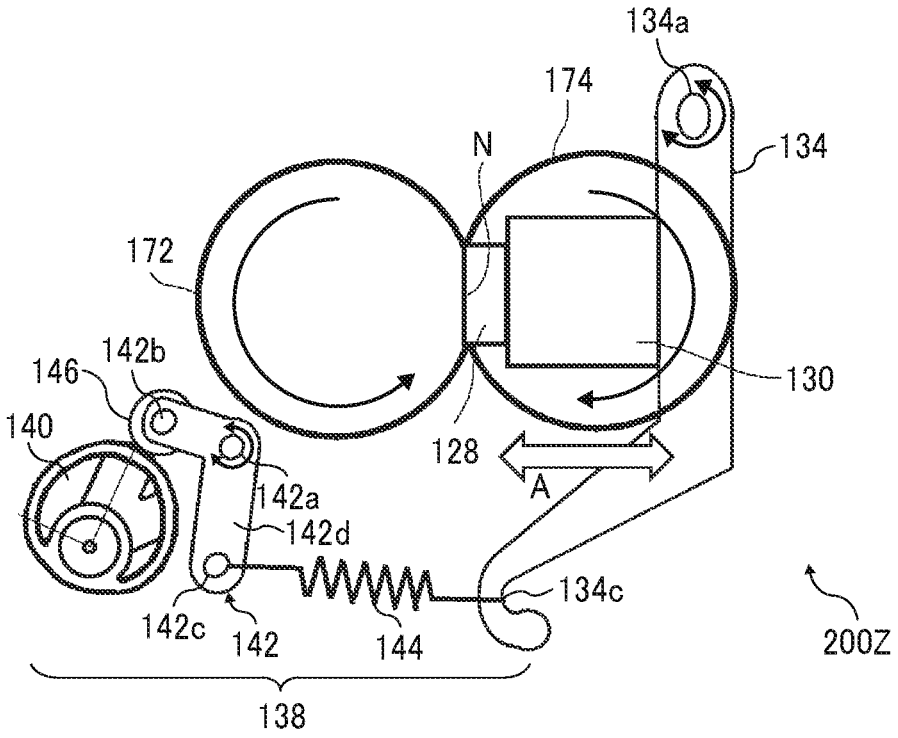
FIG. 14 is a schematic view of a pressure and pressure relief device according to yet another embodiment of the present disclosure.

FIG. 14 is a schematic view of a pressure and pressure relief device 200Z according to yet another embodiment of the present disclosure.

As illustrated in FIG. 14, the pressure and pressure relief device 200Z includes a rotator 172, a pressure body 174, and the biasing mechanism 138. The rotator 172 is rotatable in a direction of rotation as illustrated in FIG. 14. The pressure body 174 presses against the rotator 172 to sandwich and convey an object with the rotator 172. The biasing mechanism 138 biases the pressure body 174 to the rotator 172.

The biasing mechanism 138 has technical features described above with reference to FIGS. 4 and 5.

The pressure and pressure relief device described above can be used incorporating the conveyance roller 75 or 76 in the image forming apparatus 1 illustrated in FIG. 1. The pressure and pressure relief device described above can be used not only for the fixing device and the image forming apparatus, but also for other purposes. For example, the pressure and pressure relief device described above can be assembled in, e.g., a conveyor line of a factory to be used to sandwich and convey an object. In any cases, the pressure and pressure relief device according to the embodiments described above can reduce output of the driver and can be downsized compared to comparative pressure and pressure relief devices. That is, the pressure and pressure relief device according to the embodiments described above can be incorporated in a relatively small device having a limited space.

According to the embodiments described above, the second pressure lever of the pressure and pressure relief device has a leverage ratio of L4/L3 greater than one, thereby lowering the output of the driver compared to a comparative pressure and pressure relief device. In addition, the second pressure lever is smaller than the first pressure lever. Thus, the pressure and pressure relief device is downsized compared to the comparative pressure and pressure relief device.

Accordingly, the fixing device incorporating the pressure adjusting mechanism is downsized. Further, the image forming apparatus incorporating the downsized fixing device is downsized. The driver that drives the cam is also downsized while decreasing a torque.

Although the present disclosure makes reference to specific embodiments, it is to be noted that the present disclosure is not limited to the details of the embodiments described above and various modifications and enhancements are possible without departing from the scope of the present disclosure. It is therefore to be understood that the present disclosure may be practiced otherwise than as specifically described herein. For example, elements and/or features of different embodiments may be combined with each other and/or substituted for each other within the scope of the present disclosure. The number of constituent elements and their locations, shapes, and so forth are not limited to any of the structure for performing the methodology illustrated in the drawings.

Any one of the above-described operations may be performed in various other ways, for example, in an order different from that described above.

What is claimed is:

1. A pressure and pressure relief device comprising:

a rotator rotatable in a direction of rotation;

a pressure body to press against the rotator to sandwich and convey an object with the rotator;

a first pressure lever rotatably supported at a first fulcrum, the first pressure lever having a point of load to press the pressure body, the first pressure lever including a hook portion; and a biasing mechanism coupled to the first pressure lever to press the pressure body against the rotator and to relieve pressure on the pressure body, the biasing mechanism including:

a first elastic body coupled to the hook portion of the first pressure lever;

a second pressure lever rotatably supported at a second fulcrum, the second pressure lever including a continuous link extending in two directions from the second fulcrum at an angle;

a cam rotatable in a direction of rotation; and a cam follower to contact the cam, the continuous link of the second pressure lever having one end including a fastened portion coupled to the first elastic body, the continuous link of the second pressure lever having another end including a pivot to rotatably support the cam follower, wherein a relation of L1>L3, a relation of L2>L4, and a relation of L3<L4 are satisfied, where L1 represents a length between the first fulcrum of the first pressure lever and the point of load of the first pressure lever, L2 represents a length between the point of load of the first pressure lever and the hook portion of the first pressure lever, L3 represents a length between the pivot of the second pressure lever and the second fulcrum of the second pressure lever, and L4 represents a length between the second fulcrum of the second pressure lever and the fastened portion of the second pressure lever.

2. The pressure and pressure relief device according to claim 1, further comprising a housing, wherein the rotator is an elastic roller rotatable in a direction of rotation and having a shaft center secured to and supported by the housing, and wherein the pressure body is an endless fixing belt, formed into a loop, to contact the elastic roller and rotate in accordance with rotation of the elastic roller.

3. The pressure and pressure relief device according to claim 2, wherein a relation of a radial compression amount of the elastic roller<Ln<the radial compression amount of the elastic roller+a deformation amount of the fixing belt is satisfied, where Ln represents a pressure releasing amount of the fixing belt that moves when pressure is relieved.

4. The pressure and pressure relief device according to claim 2, further comprising:

a nip formation pad disposed inside the loop formed by the fixing belt to form a fixing nip between the fixing belt and the elastic roller;

a support to support the nip formation pad; and a holder to hold an end of the fixing belt in an axial direction of the fixing belt and an end of the support in a longitudinal direction of the support parallel to the axial direction of the fixing belt, the holder being supported by the housing and movable to at least one of a pressure position and a pressure relief position relative to the housing, wherein the first pressure lever has the point of load to contact the holder.

5. The pressure and pressure relief device according to claim 4, further comprising:

a second elastic body coupled to the housing and to the holder to bias the holder in a direction to relieve pressure on the fixing nip; and a regulator to regulate a moving amount of the holder.

6. The pressure and pressure relief device according to claim 5, wherein the second elastic body is a tension spring to bias the fixing belt away from the elastic roller.

7. The pressure and pressure relief device according to claim 5, wherein the second elastic body is a compression spring to bias the fixing belt away from the elastic roller.

8. The pressure and pressure relief device according to claim 4, further comprising:

a second elastic body coupled to the housing and to the support to bias the support in a direction to relieve pressure on the fixing nip; and a regulator to regulate a moving amount of the holder.

9. The pressure and pressure relief device according to claim 4, further comprising:

a second elastic body coupled to the housing and to the nip formation pad to bias the nip formation pad in a direction to relieve pressure on the fixing nip; and a regulator to regulate a moving amount of the holder.

10. A fixing device comprising:

the pressure and pressure relief device according to claim 1; and a heater to heat at least one of the rotator and the pressure body.

11. An image forming apparatus comprising:

an image bearer to bear a toner image; and the fixing device according to claim 10, the fixing device disposed downstream from the image bearer in a recording medium conveyance direction to fix the toner image onto a recording medium.

* * * * *